US010328721B2

(12) United States Patent
Ojima et al.

(10) Patent No.: US 10,328,721 B2
(45) Date of Patent: Jun. 25, 2019

(54) PRINTING APPARATUS

(71) Applicant: SHOWA ALUMINUM CAN CORPORATION, Tokyo (JP)

(72) Inventors: Shinichi Ojima, Tokyo (JP); Kazunori Ikeda, Tokyo (JP); Tetsuo Kashiwazaki, Tokyo (JP); Asumi Suwa, Tokyo (JP)

(73) Assignee: SHOWA ALUMINUM CAN CORPORATION, Tokyo (JP)

( * ) Notice: Subject to any disclaimer, the term of this patent is extended or adjusted under 35 U.S.C. 154(b) by 0 days.

(21) Appl. No.: 15/745,571

(22) PCT Filed: Jul. 7, 2016

(86) PCT No.: PCT/JP2016/070169
§ 371 (c)(1),
(2) Date: Jan. 17, 2018

(87) PCT Pub. No.: WO2017/022402
PCT Pub. Date: Feb. 9, 2017

(65) Prior Publication Data

US 2018/0207955 A1 Jul. 26, 2018

(30) Foreign Application Priority Data

Aug. 5, 2015 (JP) ..... 2015-155075
Aug. 5, 2015 (JP) ..... 2015-155076
(Continued)

(51) Int. Cl.
*B41J 2/01* (2006.01)
*B41J 3/407* (2006.01)
(Continued)

(52) U.S. Cl.
CPC ..... *B41J 11/002* (2013.01); *B05C 5/00* (2013.01); *B05C 9/12* (2013.01); *B05C 13/02* (2013.01);
(Continued)

(58) Field of Classification Search
CPC ... B41J 2/01; B41J 3/4073; B41J 3/543; B41J 11/002; B41J 11/0095; B41M 1/40;
(Continued)

(56) References Cited

U.S. PATENT DOCUMENTS 8,690,313 B2 4/2014 Yamanobe
2006/0137548 A1 6/2006 Vetter
(Continued)

FOREIGN PATENT DOCUMENTS

CN 100999152 A 7/2007
CN 103328336 A 9/2013
(Continued)

OTHER PUBLICATIONS

International Search Report for PCT/JP2016/070169 dated Sep. 20, 2016 [PCT/ISA/210].
(Continued)

*Primary Examiner* — Anh T Vo
(74) *Attorney, Agent, or Firm* — Sughrue Mion, PLLC

(57) ABSTRACT

A printing apparatus including a can body conveyance unit, an image forming unit, a light irradiation unit and one or more other can body stop locations. Light for curing an image on a can body is inhibited from reaching the image forming unit. An upstream side restricting wall (31) is positioned on the upstream side, namely, the side on which an ink jet head (240) is provided, of a can body (10) when the can body (10) is stopped at a mandrel stop location (811) or light irradiation stop location (811). The upstream side restricting wall (31) is thereby positioned between the can
(Continued)

body (10) and the ink jet head (240), and ultraviolet light is restricted from heading toward the ink jet head (240).

23 Claims, 6 Drawing Sheets

(30) Foreign Application Priority Data

Aug. 5, 2015 (JP) ..... 2015-155077
Oct. 5, 2015 (JP) ..... 2015-197368

(51) Int. Cl.

| | |
|---|---|
| ***B41J 11/00*** | (2006.01) |
| ***B05C 5/00*** | (2006.01) |
| ***B41M 1/40*** | (2006.01) |
| ***B41M 7/00*** | (2006.01) |
| ***B05C 9/12*** | (2006.01) |
| ***B05C 13/02*** | (2006.01) |
| ***B41M 5/00*** | (2006.01) |
| *B65D 1/16* | (2006.01) |
| *B41J 3/54* | (2006.01) |

(52) U.S. Cl.
CPC ..... *B41J 2/01* (2013.01); *B41J 3/4073* (2013.01); *B41J 11/0095* (2013.01); *B41M 1/40* (2013.01); *B41M 5/0088* (2013.01); *B41M 7/0081* (2013.01); *B41J 3/543* (2013.01); *B65D 1/165* (2013.01)

(58) Field of Classification Search
CPC ..... B41M 5/0088; B41M 7/0081; B05C 5/00; B05C 9/12; B05C 13/02; B65D 1/165
See application file for complete search history.

(56) References Cited

U.S. PATENT DOCUMENTS

| | | | |
|---|---|---|---|
| 2007/0157559 | A1 | 7/2007 | Till |
| 2009/0145511 | A1 | 6/2009 | Till |
| 2009/0322850 | A1 | 12/2009 | Tamaru et al. |
| 2010/0257819 | A1 | 10/2010 | Schach |
| 2011/0007119 | A1 | 1/2011 | Baba et al. |
| 2013/0176358 | A1 | 7/2013 | Yamada et al. |
| 2014/0049585 | A1 | 2/2014 | Tashiro et al. |
| 2014/0368841 | A1 | 12/2014 | Ojima et al. |
| 2015/0010722 | A1 | 1/2015 | Yamada et al. |
| 2016/0200524 | A1 | 7/2016 | Neubauer et al. |
| 2016/0221708 | A1 | 8/2016 | Ojima et al. |
| 2016/0229198 | A1 | 8/2016 | Izume |
| 2017/0157950 | A1 | 6/2017 | Tashiro et al. |
| 2018/0093496 | A1 | 4/2018 | Izume |
| 2018/0207955 | A1 | 7/2018 | Ojima et al. |

FOREIGN PATENT DOCUMENTS

| | | | |
|---|---|---|---|
| DE | 10 2013 217 674 | A1 | 3/2015 |
| JP | 3-188976 | A | 8/1991 |
| JP | 2003-252318 | A | 9/2003 |
| JP | 2004-201432 | A | 7/2004 |
| JP | 2005-531428 | A | 10/2005 |
| JP | 2007-167946 | A | 7/2007 |
| JP | 2009-178708 | A | 8/2009 |
| JP | 2010-008913 | A | 1/2010 |
| JP | 2012-177460 | A | 9/2012 |
| JP | 2012-228635 | A | 11/2012 |
| JP | 2013-132640 | A | 7/2013 |
| JP | 2013-166587 | A | 8/2013 |
| JP | 2013-169975 | A | 9/2013 |
| JP | 2013-177571 | A | 9/2013 |
| JP | 2014-050786 | A | 3/2014 |
| JP | 5585328 | B2 | 9/2014 |
| JP | 2015-064217 | A | 4/2015 |
| JP | 201583480 | A | 4/2015 |
| JP | 2017-030298 | A | 2/2017 |
| WO | 2012/053406 | A1 | 4/2012 |
| WO | 2012-147612 | A1 | 11/2012 |
| WO | 2015/046119 | A1 | 4/2015 |
| WO | 2015/060028 | A1 | 4/2015 |

OTHER PUBLICATIONS

Extended European Search Report including the supplementary European search report and the European search opinion dated Mar. 18, 2019 from the European Patent Office for counterpart Application No. 16832681.7.

PRINTING APPARATUS

CROSS REFERENCE TO RELATED APPLICATIONS

This application is a National Stage of International Application No. PCT/JP2016/070169 filed Jul. 7, 2016, claiming priority based on Japanese Patent Application Nos. 2015-155075 filed Aug. 5, 2015, 2015-155076 filed Aug. 5, 2015, 2015-155077 filed Aug. 5, 2015 and 2015-197368 filed Oct. 5, 2015, the contents of all of which are incorporated herein by reference in their entirety.

TECHNICAL FIELD

The present invention relates to a printing apparatus.

BACKGROUND ART

In Patent Document 1, there is disclosed a printer including: a mandrel wheel; plural automatically-rotatable mandrels provided in the mandrel wheel; and plural ink jet printing stations for forming print images onto an outer surface of a cylindrical container installed in the mandrel.

CITATION LIST

Patent Literature

Patent Document 1: Japanese Patent Application Laid-Open Publication No. 2014-50786

SUMMARY OF INVENTION

Technical Problem

To form an image onto a can body, for example, an image forming unit that performs image formation onto the can body by ejecting ink to be cured by irradiation of light is provided, and the ink is ejected from the image forming unit toward the can body. Then, the can body is irradiated with light, such as ultraviolet light, to cure the ink on the can body.

Here, when the light irradiated onto the can body heads for the image forming unit, curing of ink occurs at the image forming unit, and therefore, it becomes difficult to form an image, or quality of an image to be formed is deteriorated.

An object of the present invention is to prevent light for curing an image on a can body from reaching an image forming unit.

Moreover, in a printing apparatus performing printing onto a can body, for example, a can body support member is rotated, to thereby rotate the can body in a circumferential direction, and ink is caused to adhere to an outer circumferential surface of the rotating can body to perform printing.

Here, in a configuration providing plural can body support members and also providing plural driving sources corresponding to the respective can body support members, manufacturing costs are increased. Moreover, to perform printing, printing is performed per each color in some cases, and in these cases, alignment among images of respective colors is required. In such cases, if a driving source is provided per each can body support member, a process of aligning the images is apt to be complicated.

Another object of the present invention is to reduce the driving sources for rotating the respective plural can body support members.

Moreover, in image formation onto a can body, image formation is performed by plural image forming units in some cases, and in these cases, alignment among images formed by the respective image forming units is required.

Alignment of images can be performed by, for example, detecting a status of the can body by a sensor and performing image formation based on the detection result; however, if the sensor is used in this manner, the process is apt to be complicated.

Another object of the present invention is to perform alignment among images formed on a can body by respective plural image forming units easier.

Moreover, to form an image on a can body, for example, plural image forming units that perform image formation onto the can body by ejecting ink are provided, the can body is moved among the plural image forming units in order, and the can body is stopped at positions facing the respective image forming units, to thereby perform image formation.

Here, even in a case in which movement of the can body is stopped at the positions facing the respective image forming units, the can body vibrates in some cases when image formation is started at the image forming units. Then, when the can body vibrates, there is a possibility that positions of ink ejection by the image forming units are varied and the quality of images formed by the image forming units is deteriorated.

Another object of the present invention is, when the can body is moved to the plural image forming units in order to form the images, to reduce vibration of the can body in starting image formation at each image forming unit.

Solution to Problem

A printing apparatus to which the present invention is applied includes: a can body conveyance unit that sequentially conveys can bodies and, every time each of the can bodies reaches each of predetermined plural can body stop locations, temporarily stops the can body; an image forming unit that is installed at any of the plural can body stop locations and performs image formation onto the can body positioned at the can body stop location; and a light irradiation unit that is installed at another can body stop location positioned on a downstream side of the can body stop location, where the image forming unit is installed, in a conveyance direction of the can bodies, and performs light irradiation to an image formed onto the can body by the image forming unit, wherein one or more other can body stop locations are provided between an image formation stop location, which is the can body stop location where the image forming unit is installed, and a light irradiation stop location, which is the can body stop location where the light irradiation unit is installed.

Here, a restricting wall that restricts light emitted from the light irradiation unit from heading toward the image forming unit is further included.

Moreover, the restricting walls are plurally provided to correspond to the respective can bodies conveyed by the can body conveyance unit, and move in association with the respective can bodies conveyed by the can body conveyance unit, and the plural restricting walls are provided, when one of the can bodies is stopped at the light irradiation stop location, to cause one of the plural restricting walls corresponding to the can body to be positioned on an upstream side of the can body in the can body conveyance direction.

Moreover, two or more of the restricting walls are provided for each of the can bodies, and, when the each can body is stopped at the light irradiation stop location, one of the restricting walls corresponding to the can body is positioned on an upstream side of the can body in the can body conveyance direction, and the other of the restricting walls corresponding to the can body is positioned on a downstream side of the can body in the can body conveyance direction.

Moreover, the image forming unit performs image formation on the can body by ejecting ink onto the can body, and an ink ejection direction when the image forming unit ejects the ink and a light emitting direction in light emission by the light irradiation unit are the same.

Moreover, the image forming units are plurally provided, the light irradiation unit is positioned on a downstream side of the plural image forming units in a moving direction of the can body, and light irradiation by the light irradiation unit is performed after image formation onto the can body by the plural image forming units is performed.

From another standpoint, a printing apparatus to which the present invention is applied includes: plural can body support members that are provided rotatably to support can bodies; an image forming unit that performs image formation onto the can bodies supported by the can body support members; and a transmission member that performs circulating movement through each of the plural can body support members to transmit a rotational driving force to each of the plural can body support members.

Here, the plural can body support members are radially disposed around a predetermined disposition center, the transmission member is formed into an annular shape to perform circulating movement assuming a center in a radial direction as a movement center, and the plural can body support members and the transmission member are provided to cause the disposition center and the movement center to coincide with each other.

Moreover, the transmission member is installed closer to the disposition center side than the plural can body support members that are radially disposed.

Moreover, a receiving member that receives a driving force from the transmission member is provided to each of the can body support members, and the receiving member is formed into a helical shape.

Moreover, a receiving member that receives a driving force from the transmission member is provided to each of the can body support members, and the receiving member is more likely to wear than the transmission member.

Moreover, the image forming units are plurally provided, and a moving unit that moves the can body support members through each of the plural image forming units is further included.

From another standpoint, a printing apparatus to which the present invention is applied includes: plural image forming units, each of which ejects ink onto an outer circumferential surface of a rotating can body to form an image on the outer circumferential surface; and a moving unit that moves a can body through each of the plural image forming units while rotating the can body, wherein a number of rotations of the can body during a period from starting moving of the can body from one of two of the image forming units adjacent to each other in a moving direction of the can body to reaching the other of the two image forming units becomes an integer.

Here, when image formation onto the can body is performed at each of the plural image forming units, the can body is rotated for a predetermined number of rotations, and, when the can body is moved from one of the two image forming units to the other thereof, the can body is rotated for a number of rotations larger than the predetermined number of rotations.

Moreover, when image formation onto the can body is performed at each of the plural image forming units, the can body is rotated for a predetermined number of rotations, and, when the can body is moved from one of the two image forming units to the other thereof, the can body is rotated for a number of rotations smaller than the predetermined number of rotations.

Moreover, the printing apparatus further includes: an inspection unit that performs inspection of a can body before image formation onto the can body by the plural image forming units is performed; and a discharge unit that discharges a can body, which is determined not to satisfy a predetermined condition by the inspection unit, before image formation onto the can body by the plural image forming units is performed.

Moreover, the can body is supported by a cylindrical member inserted into the can body, and the cylindrical member is formed with a diameter of one end portion side in a lead when being inserted into the can body to be smaller than a diameter of the other end portion side.

From another standpoint, a printing apparatus to which the present invention is applied includes: plural image forming units, each of which ejects ink onto an outer circumferential surface of a rotating can body to form an image on the outer circumferential surface; a moving unit that moves and stops a can body to and at each of the plural image forming units to cause the can body to pass through each of the plural image forming units; and a rotating unit that rotates a can body after the can body is stopped at each of the plural image forming units by the moving unit, wherein each of the plural image forming units starts image formation onto the can body after the can body is rotated a predetermined number of times by the rotating unit.

Here, each of the image forming units starts image formation onto the can body after the can body is rotated an integer number of times by the rotating unit. In this case, it becomes possible to perform alignment among the images formed on the can body by the respective plural image forming units easier.

Moreover, the rotating unit rotates the can body to cause image formation starting positions by the respective image forming units to coincide with one another.

Further, the rotating unit rotates the can body to cause image formation starting positions by the respective image forming units to be shifted in a circumferential direction of the can body.

Still further, the rotating unit rotates the can body to cause a moving direction of the can body by the moving unit and a rotation direction of the can body at a portion facing each of the image forming units to coincide with each other.

Moreover, there is further included a light irradiation unit that is provided on a downstream side of the plural image forming units in a moving direction of the can body and performs light irradiation onto the image formed on the can body by the plural image forming units, wherein the rotating unit rotates a can body after the can body is stopped at the light irradiation unit by the moving unit, and the light irradiation unit starts light irradiation onto the can body when the can body is rotated by the rotating unit.

Advantageous Effects of Invention

According to the present invention, it is possible to prevent light for curing the image on the can body from reaching the image forming unit.

Moreover, according to the present invention, it is possible to reduce the driving sources for rotating the respective plural can body support members.

Moreover, according to the present invention, it is possible to perform alignment among the images formed on the can body by the respective plural image forming units easier.

Moreover, according to the present invention, it is possible to, when the can body is moved to the plural image forming units in order to form the images, reduce vibration of the can body in starting image formation at each image forming unit.

DESCRIPTION OF EMBODIMENTS

Hereinafter, an exemplary embodiment according to the present invention will be described in detail with reference to attached drawings.

Figure 1:
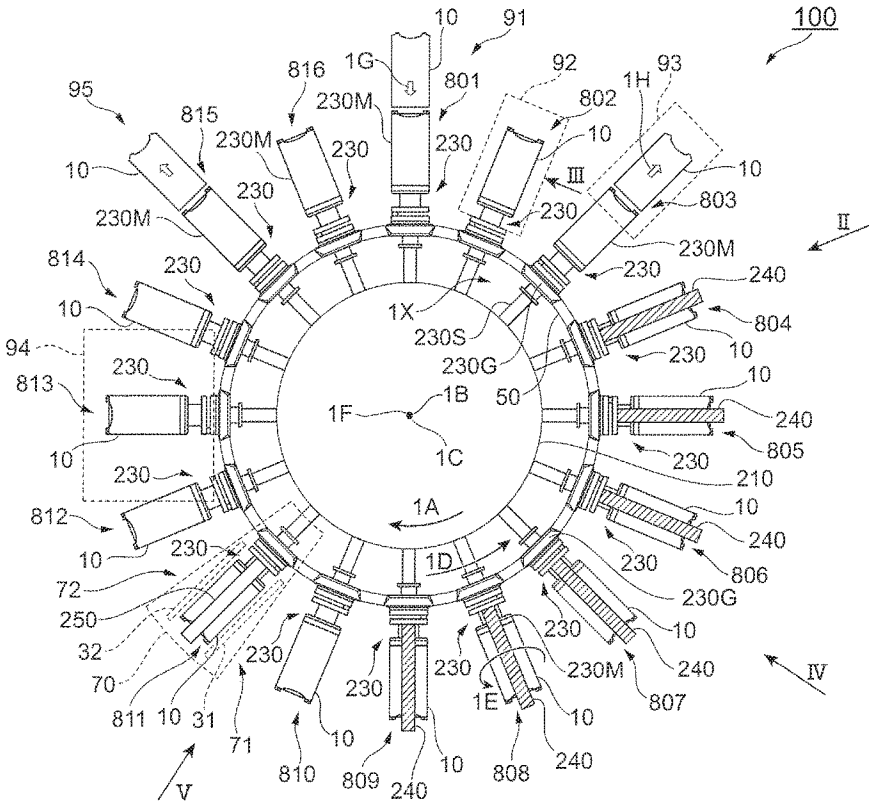
FIG. 1 is a diagram in which a printing apparatus is viewed from above.

FIG. 1 is a diagram in which a printing apparatus 100 related to the exemplary embodiment is viewed from above.

The printing apparatus 100 shown in FIG. 1 forms an image onto a can body 10 used as a beverage can or the like based on digital image information. Moreover, the printing apparatus 100 forms an image on the can body 10 by use of an ink jet method.

The printing apparatus 100 is provided with a control part (not shown) that controls respective devices and respective mechanisms provided to the printing apparatus 100. The control part is composed of a program-controlled CPU.

Moreover, the printing apparatus 100 is provided with a rotation member 210 that is driven by a not-shown motor and rotates intermittently in a direction indicated by arrow 1A in the figure. The rotation member 210 is formed into a columnar shape to rotate around a rotation axis 1B indicated by a reference sign 1B in the figure. The rotation axis 1B extends in the vertical direction.

Moreover, the printing apparatus 100 is provided with plural (in the exemplary embodiment, 16) holding mechanisms 230 that are provided to protrude from an outer circumferential surface of the rotation member 210 and hold the can bodies 10.

As indicated by the reference sign 1X, each of the holding mechanisms 230 is provided with a shaft 230S protruding from the outer circumferential surface of the rotation member 210. The shaft 230S is rotatable in the circumferential direction.

Moreover, as indicated by the reference sign 1X, each of the holding mechanisms 230 is provided with a mandrel 230M as an example of a can body support member that supports the can body 10. The mandrel 230M is attached to a tip end of the shaft 230S.

Further, between the mandrel 230M and the rotation member 210, a receiving gear 230G as an example of a receiving member that receives a rotational driving force is provided.

The receiving gear 230G is attached to an outer circumferential surface of the shaft 230S.

Moreover, the receiving gear 230G is composed of a helical gear. Further, the receiving gear 230G is engaged with a transmission gear 50 in an annular shape (to be described in detail later) and receives the rotational driving force from the transmission gear 50.

The plural shafts 230S and the plural mandrels 230M are provided, and these shafts 230S and mandrels 230M are disposed radially around a disposition center 1C indicated by the reference sign 1C in the figure. Note that the disposition center 1C coincides with the rotation axis 1B of the rotation member 210.

The can body 10 is formed into a cylindrical shape. Moreover, a bottom portion is formed at an end portion in the longitudinal direction of the can body 10 to close the end portion. On the other hand, the other end portion of the can body 10 is not closed and left opened.

As indicated by arrow 1G in FIG. 1, the mandrel 230M is inserted into the can body 10 from the open side, and thereby the can body 10 is supported by the mandrel 230M.

Further, below the plural holding mechanisms 230 that are radially disposed and on the outside of the rotation member 210 in the radial direction, the annular-shaped transmission gear 50 that functions as a transmission member or a rotation member is provided. The transmission gear 50 is engaged with the receiving gears 230G provided to the respective holding mechanisms 230, and thereby the rotational driving force is transmitted to the receiving gears 230G to rotate the mandrels 230M.

More specifically, the transmission gear 50 is formed into an annular shape and circularly moves (orbitally moves) in the direction indicated by arrow 1D in the figure. Then, in the exemplary embodiment, the receiving gears 230G are engaged with the transmission gear 50 that is circularly moving, and thereby the receiving gears 230G are rotated to rotate the mandrels 230M (the can bodies 10) in the direction indicated by the arrow 1E.

Here, the transmission gear 50 circularly moves around the center in the radial direction that is assumed to be a movement center 1F; however, in the exemplary embodiment, the movement center 1F and the disposition center 1C of the mandrels 230M radially disposed coincide with each other.

To additionally describe, when the printing apparatus 100 is viewed from above, the movement center 1F and the disposition center 1C are positioned at the same location. Further, at the location where the movement center 1F and the disposition center 1C are positioned, the rotation axis 1B of the rotation member 210 is also positioned.

Further, in the exemplary embodiment, the transmission gear 50 is positioned closer to the disposition center 1C side than the radially-disposed mandrels 230M.

Consequently, in the exemplary embodiment, the printing apparatus 100 can be maintained with ease as compared to a case in which the transmission gear 50 is provided to an opposite side of the disposition center 1C (to an outer side than the mandrels 230M in the radial direction of the rotation member 210).

In doing maintenance, the mandrels 230M are attached or detached in some cases, and in these cases, if the transmission gear 50 is provided to the disposition center 1C side, the mandrels 230M can be accessed with ease as compared to the case in which the transmission gear 50 is provided to the opposite side of the disposition center 1C. This makes it possible to attach or detach the mandrels 230M easier and to enhance ease of maintenance.

Further, in the exemplary embodiment, the transmission gear 50 is formed of a metallic material, and the receiving gear 230G is formed of a resin material. Consequently, the receiving gear 230G is more likely wear than the transmission gear 50. This also makes it easier to do maintenance.

If the transmission gear 50 is more likely to wear, when the gears are replaced, it becomes necessary to attach and detach the transmission gear 50, which is larger than the receiving gear 230G; therefore, a lot of trouble is taken.

Moreover, the printing apparatus 100 is provided with 6 ink jet heads 240 that function as image forming units.

The 6 ink jet heads 240 are arranged along the moving direction of the can body 10. Further, the 6 ink jet heads 240 are disposed radially, too. Further, the ink jet heads 240 are disposed above the can body 10, to thereby eject ink toward the can body 10 positioned below.

Figure 2:
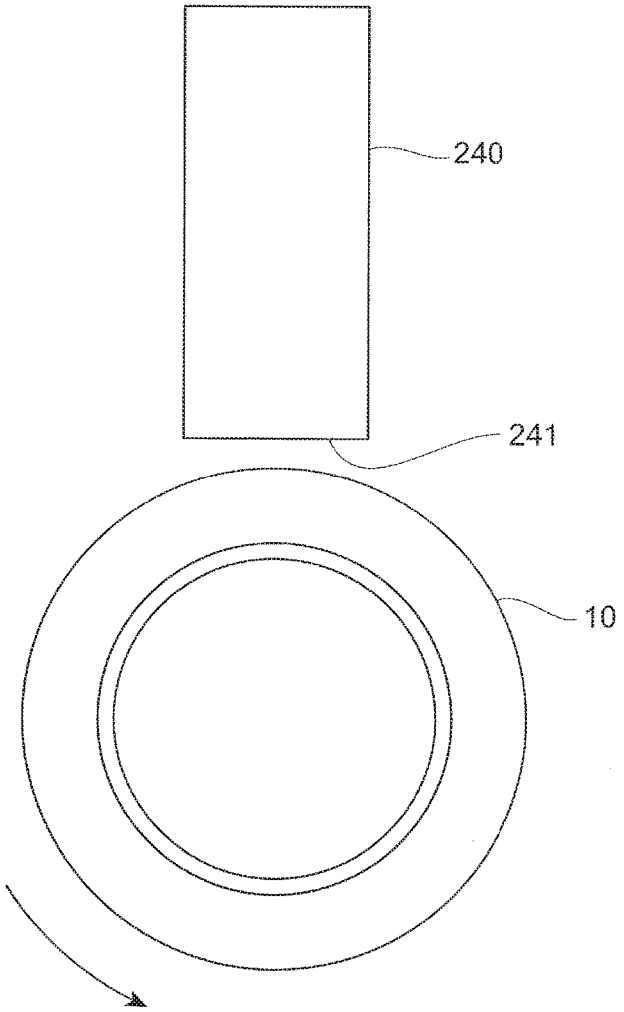
FIG. 2 is a diagram in which an ink jet head and a can body are viewed from a direction of arrow II in FIG. 1.

FIG. 2 is a diagram in which the ink jet head 240 and the can body 10 (the can body 10 supported by the mandrel 230M) are viewed from the direction of arrow II in FIG. 1.

As shown in FIG. 2, the ink jet head 240 is disposed above the can body 10. Further, the ink jet head 240 includes a lower surface 241 that faces the can body 10, and the lower surface 241 is provided with plural ink ejection ports (not shown) that eject ink.

The ink jet head 240 in the exemplary embodiment ejects ultraviolet cure ink to form an image onto the outer circumferential surface of the can body 10.

Further, the 6 ink jet heads 240 are provided in the exemplary embodiment, and the respective ink jet heads 240 eject ink of different colors, such as yellow, magenta, cyan, black, white or a special color, from one another onto the can body 10.

Moreover, as shown in FIG. 1, in the exemplary embodiment, in the rotation direction of the rotation member 210 (the conveyance direction of the can body 10), a UVLED (Ultraviolet Light Emitting Diode) lamp 250 that functions as a light irradiation unit is provided on a downstream side of the 6 ink jet heads 240. The outer circumferential surface of the can body 10 is irradiated with ultraviolet light from the UVLED lamp 250, and thereby the ultraviolet cure ink constituting an image on the outer circumferential surface of the can body 10 is cured.

Further, a lamp container box 70 for containing the UVLED lamp 250 is provided. By providing the lamp container box 70, the ultraviolet light is prevented from heading toward anything other than the can body 10.

The lamp container box 70 is provided with an inlet portion 71, through which the mandrel 230M (the can body 10) passes when entering the lamp container box 70, and an outlet portion 72, through which the mandrel 230M passes when exiting from the lamp container box 70.

The rotation member 210, which functions as a can body conveyance unit and a moving unit, causes the mandrel 230M (the can body 10) to pass through the respective plural ink jet heads 240 to move thereof. Further, the rotation member 210 temporarily stops rotation per every rotation of 22.5 degrees.

Consequently, the exemplary embodiment has a configuration providing 16 mandrel stop locations (can body stop locations) 801 to 816 in total.

In the exemplary embodiment, the rotation member 210 is rotated to sequentially convey the can bodies 10 along a predetermined orbital route, and the can body 10 is temporarily stopped every time the can body 10 reaches each of the 16 mandrel stop locations.

In the exemplary embodiment, the ink jet heads 240 are provided to 6 mandrel stop locations 804 to 809, of the 16 mandrel stop locations 801 to 816; further, to another one mandrel stop location 811, a UVLED lamp 250 is provided.

Further, the exemplary embodiment includes a configuration in which one other mandrel stop location (the mandrel stop location indicated by the reference sign 810) is provided between the mandrel stop locations 804 to 809 provided with the ink jet heads 240 (hereinafter, referred to as "image formation stop locations 804 to 809" in some cases) and the mandrel stop location 811 provided with the UVLED lamp 250 (hereinafter, referred to as "light irradiation stop location 811" in some cases).

Here, in the exemplary embodiment, ultraviolet light is emitted from the UVLED lamp 250, and when the ultraviolet light reaches the ink jet head 240 positioned on the upstream side, there occurs a possibility that the ink is cured to cause ink clogging in the ink jet head 240, and thereby quality of an image to be formed is deteriorated.

Therefore, in the exemplary embodiment, as described above, by providing one mandrel stop location 810 between the image formation stop locations 804 to 809 and the light irradiation stop location 811 to increase a separation distance between the UVLED lamp 250 and the ink jet heads 240, to thereby reduce ultraviolet light that reaches the ink jet heads 240.

Note that, in the exemplary embodiment, there is provided one mandrel stop location 810 between the image formation stop locations 804 to 809 and the light irradiation stop location 811; however, two or more mandrel stop locations may be provided.

Further, in the exemplary embodiment, an ink ejection direction when the ink jet head 240 ejects ink toward the can body 10 and a light emitting direction when the UVLED lamp 250 emits light toward the can body 10 are the same.

Specifically, the ink ejection direction when the ink jet head 240 ejects ink toward the can body 10 is a downward direction, and the light emitting direction when the UVLED lamp 250 emits light toward the can body 10 is also a downward direction. This also reduces the ultraviolet light that reaches the ink jet heads 240.

Here, for example, in a configuration in which the UVLED lamp 250 is disposed below the can body 10, the ultraviolet light is emitted upwardly. On the other hand, in the ink jet head 240, the ink ejection ports are provided to the lower surface 241 (refer to FIG. 2).

In this case, as compared to the case in which the ink ejection direction and the light emitting direction are the same as in the exemplary embodiment, the ultraviolet light is likely to reach the ink ejection ports, and therefore, curing of ink easily occurs in the ink jet heads 240.

Further, in the printing apparatus 100 of the exemplary embodiment, as shown in FIG. 1, a can body loading portion 91 is provided on an upstream side of the plural ink jet heads 240.

At the can body loading portion 91, inside of the mandrel 230M formed into a cylindrical shape is caused to have negative pressure, and the mandrel 230M sucks the can body 10 to insert the mandrel 230M into the inside of the can body 10. Consequently, support of the can body 10 by the mandrel 230M is started.

Between the can body loading portion 91 and the ink jet heads 240, an inspection mechanism 92 as an example of an inspection unit that investigates the loaded can body 10 is provided.

In the exemplary embodiment, the inspection mechanism 92 is provided on the upstream side of the ink jet heads 240; thereby, inspection of the can body 10 is performed prior to image formation by the ink jet heads 240.

Specifically, the inspection mechanism 92 inspects whether or not the can body 10 is deformed.

Figure 3:
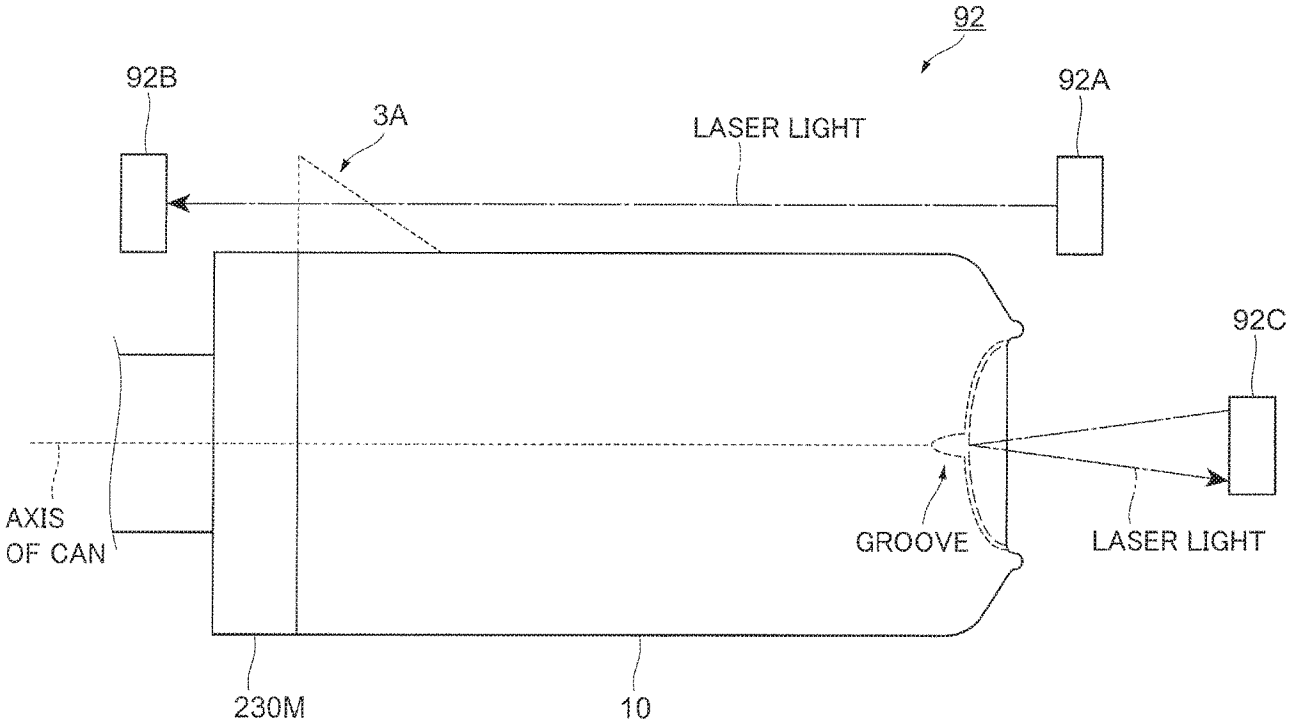
FIG. 3 is a diagram in which an inspection mechanism is viewed from a direction of arrow III in FIG. 1.

More specifically, the inspection mechanism 92 is, as shown in FIG. 3 (a diagram in which the inspection mechanism 92 is viewed from the direction of arrow III in FIG. 1), provided with a light source 92A on one end portion side of the can body 10, the light source 92A emitting laser light that proceeds in the axial direction of the can body 10 along the outer circumferential surface of the can body 10. Further, on the other end portion side of the can body 10, there is provided a light receiving portion 92B that receives laser light from the light source 92A.

When part of the can body 10 is deformed as indicated by the reference sign 3A, the laser light is cut off and the light receiving portion 92B cannot receive the laser light. Consequently, deformation of the can body 10 is detected.

Moreover, it is possible to provide a reflective laser detection device 92C that includes both of a light projecting portion with a light source for emitting laser light and a light receiving portion for receiving laser light to the inspection mechanism 92. The reflective laser detection device 92C emits laser light from the light projecting portion toward the bottom of the can, the emitted laser light is reflected off the bottom of the can, the reflected laser light is received by the light receiving portion, and thereby the distance to the bottom of the can be detected based on the time from light emitting to light receiving. Consequently, it is possible to detect whether the can body 10 is perfectly mounted to the mandrel 230M. Moreover, by forming a groove as shown in the figure onto the mandrel 230M, it is possible to detect presence or absence of the can body 10.

Then, in the exemplary embodiment, when it is determined by the inspection mechanism 92 that the can body 10 does not satisfy predetermined conditions (it is determined that the can body 10 is deformed), a discharge mechanism 93 (refer to FIG. 1) as an example of a discharge unit discharges the can body 10 to the outside of the printing apparatus 100.

Here, the discharge mechanism 93 is, as shown in FIG. 1, disposed between the inspection mechanism 92 and the ink jet heads 240 (disposed on the upstream side of the ink jet heads 240), and therefore, in the exemplary embodiment, the can body 10 is discharged before image formation by the ink jet heads 240 is performed.

In the discharge mechanism 93, compressed air is supplied to the inside of the mandrel 230M, to move the can body 10 in the direction indicated by arrow 1H in the figure. Further, the bottom portion (the closed end portion) of the can body 10 is sucked by a not-shown suction member. Then, by the suction member, the can body 10 is conveyed to the outside of the printing apparatus 100, and the can body 10 is discharged to the outside of the printing apparatus 100.

Here, if the deformed can body 10 reaches the ink jet head 240, there is a possibility that the can body 10 comes into contact with the ink jet head 240, and thereby the ink jet head 240 is damaged. In the exemplary embodiment, the deformed can body 10 is discharged to the outside of the printing apparatus 100 before reaching the ink jet head 240, to suppress damage to the ink jet head 240.

With reference to FIG. 1, the printing apparatus 100 will be further described.

On the downstream side of the UVLED lamp 250 (at the mandrel stop location 813), a paint application device 94 is provided.

The paint application device 94 includes a rotation body (not shown) capable of putting paint on an outer circumferential surface thereof, and brings the outer circumferential surface thereof into contact with the outer circumferential surface of the can body 10, to thereby apply the paint to the outer circumference of the can body 10. By applying the paint, a protection layer is formed on the outer circumferential surface of the can body 10.

Thereafter, in the exemplary embodiment, at a can body discharge portion 95 (at the mandrel stop location 815) on the downstream side of the paint application device 94, the can body 10 is discharged.

Specifically, by supplying the compressed air to the inside of the mandrel 230M, the can body 10 is detached from the mandrel 230M, and further, the can body 10 is conveyed to the outside of the printing apparatus 100 by a not-shown conveyance mechanism. Note that the can body 10 conveyed to the outside of the printing apparatus 100 is conveyed to a not-shown baking operation and subjected to heating processing.

Note that the above-described rotation body provided to the paint application device 94 has a large diameter.

Therefore, in the exemplary embodiment, a single mandrel stop location (the mandrel stop locations 812 and 814) is provided between the paint application device 94 and the can body discharge portion 95, and between the paint application device 94 and the UVLED lamp 250, to thereby prevent interference between the rotation body provided to the paint application device 94 and the can body discharge portion 95 and interference between the rotation body and the UVLED lamp 250.

With reference to FIG. 1, a series of operations of the printing apparatus 100 will be described.

To perform printing by the printing apparatus 100, first, rotation of the transmission gear 50 in the direction indicated by arrow 1D is started, and rotation of the mandrel 230M in the direction indicated by arrow 1E is started. In the exemplary embodiment, in printing, the transmission gear 50 is always rotated for a constant number of rotations.

Next, in the exemplary embodiment, at the can body loading portion 91, the can body 10 having been conveyed from the upstream side is mounted to the mandrel 230M.

Specifically, in the exemplary embodiment, the can body 10 is conveyed from the upstream side to the can body loading portion 91; on this occasion, at the can body loading portion 91, the empty mandrel 230M is on standby. Further, the inside of the mandrel 230M is caused to have a negative pressure, and, inside the mandrel 230M, a ventilation hole (not shown) communicating with the outside is laid, to thereby suck the can body 10 through the ventilation hole.

Consequently, the mandrel 230M is inserted into the inside of the can body 10, and thereby support of the can body 10 by the mandrel 230M is started.

After the support of the can body 10 by the mandrel 230M has been started, the rotation member 210 having been in a stopped state rotates 22.5 degrees in the direction indicated by arrow 1A in the figure, and is stopped again. Consequently, the can body 10 reaches the inspection mechanism 92. Thereafter, the rotation member 210 rotates 22.5 degrees again. Consequently, the can body 10 reaches the discharge mechanism 93. Thereafter, the rotation member 210 rotates 22.5 degrees again. Consequently, the can body 10 reaches below the first ink jet head 240.

Then, in the exemplary embodiment, from the first ink jet head 240, ink is ejected toward the can body 10 that is positioned below and rotating, and thereby an image by ink of a first color is formed onto the outer circumferential surface of the can body 10.

In the exemplary embodiment, in this manner, ink is ejected toward the can body 10 from above the can body 10. In this case, the acting direction of gravity and the ink ejection direction coincide with each other; accordingly, behavior of ejected ink becomes stable, and therefore, the ejection position of ink can be controlled with more accuracy.

Thereafter, in the exemplary embodiment, rotation of the rotation member 210 is restarted, and the can body 10 reaches below the second ink jet head 240. Then, an image by ink of a second color is formed by the second ink jet head 240.

Thereafter, in the exemplary embodiment, movement of the can body 10 to the third ink jet head 240, image formation by the third ink jet head 240, movement of the can body 10 to the fourth ink jet head 240 and image formation by the fourth ink jet head 240 are performed. Further, in the fifth ink jet head 240 and the sixth ink jet head 240, images are formed similarly.

Note that, in the exemplary embodiment, description has been given by taking the case in which all of the 6 ink jet heads 240 are used to form the images as an example; however, of the 6 ink jet heads 240, partial ink jet heads 240 may be used to form images.

Here, in the exemplary embodiment, the can body 10 is rotating while moving between the ink jet heads 240. Consequently, unevenness in adhered ink hardly occurs.

When the can body 10 is moved in a state where rotation of the can body 10 is stopped, there is a possibility that the ink adhered to the can body 10 moves downward by gravity and unevenness in adhered ink occurs.

Further, in the exemplary embodiment, the number of rotations of the can body 10 is increased while the can body 10 moves between the ink jet heads 240. Specifically, in the exemplary embodiment, when an image is formed onto the can body 10 in each ink jet head 240, the can body 10 is rotated for a predetermined number of rotations, whereas, when the can body 10 moves between the ink jet heads 240, the number of rotations of the can body 10 becomes larger than the predetermined number of rotations.

More specifically, in the exemplary embodiment, when an image is formed onto the can body 10 in each ink jet head 240, each of the mandrels 230M is rotated in the direction indicated by arrow 1E in the figure by rotation of the transmission gear 50.

When the mandrel 230M moves to the downstream side from this state, the receiving gear 230G moves, and by the movement, the receiving gear 230G rotates with respect to the transmission gear 50. Consequently, the number of rotations of the receiving gear 230G is increased, and the number of rotations of the can body 10 is increased in accordance with this.

Here, when the number of rotations is increased like this, the ink on the outer circumferential surface of the can body 10 is likely to be cured. More specifically, when thermosetting ink, not the ultraviolet cure ink as in the exemplary embodiment, is used for example, the ink is likely to be dried as the number of rotations is increased, and thereby, the ink is cured more quickly as compared to a case in which the number of rotations is not increased.

To additionally describe, in the above, the case in which the ultraviolet cure ink is used is described; however, in the printing apparatus 100 of the exemplary embodiment, thermosetting ink can also be used, and in this case, when the number of rotations of the can body 10 is increased, the ink is cured more quickly as compared to a case in which the number of rotations is not increased.

Note that, when the can body 10 moves between the ink jet heads 240, the number of rotations of the can body 10 may be reduced. Here, reduction of the number of rotations can be performed by rotating the transmission gear 50 not in the direction indicated by arrow 1D, but in the opposite direction indicated by arrow 1D.

When the can body 10 is going to move to the downstream side in the state where the transmission gear 50 is rotating in the opposite direction indicated by arrow 1D, the receiving gear 230G comes to rotate in the direction that reduces the number of rotations of the can body 10, and in accordance with this, the number of rotations of the can body 10 is reduced.

When the number of rotations of the can body 10 is reduced in this manner, the total number of rotations of the receiving gear 230G or the shaft 230S is reduced, and thereby wear in the receiving gear 230G or the shaft 230S can be suppressed as compared to a case in which the number of rotations is constant or is increased as described above.

Further, in the exemplary embodiment, the number of teeth of the transmission gear 50, the number of rotations of the transmission gear 50, the number of teeth of the receiving gear 230G, the number of rotations of the receiving gear 230G and the like are set so that the number of rotations of the can body 10 in moving between the ink jet heads 240 becomes an integer.

To put it another way, in the printing apparatus 100 of the exemplary embodiment, the number of rotations of the can body 10 during a period from starting to move the can body 10 from one of the two ink jet heads 240 adjacent to each other in the moving direction of the can body 10 to reaching the other thereof becomes an integer.

To describe further, during the period from starting to move the can body 10 from one of the two ink jet heads 240 adjacent to each other in the moving direction of the can body 10 to reaching the other thereof, the can body 10 moves while rotating around the axis of the can, and the number of the rotation becomes an integer multiple of a single rotation.

Figure 4:
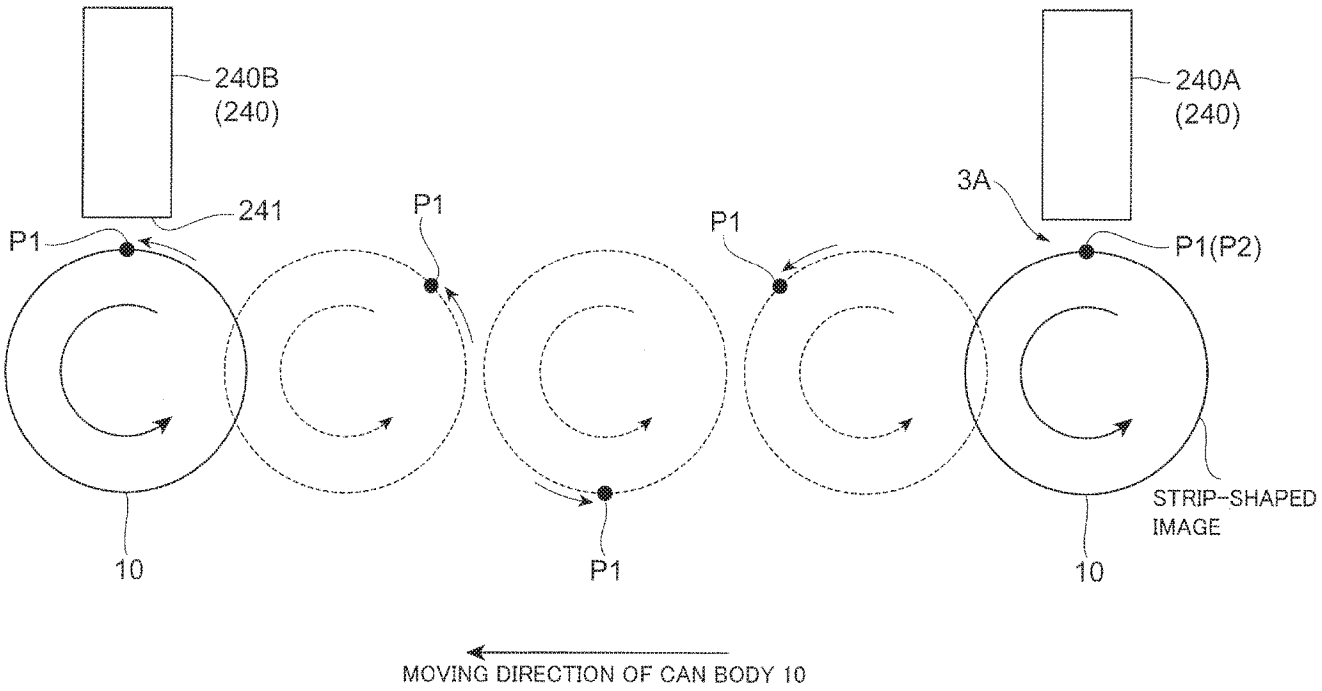
FIG. 4 is a schematic view in which two ink jet heads adjacent to each other are viewed from a direction of arrow IV in FIG. 1.

FIG. 4 is a schematic view in which two ink jet heads 240 adjacent to each other are viewed from the direction indicated by arrow IV in FIG. 1.

In the exemplary embodiment, the can body 10 is always rotating, and the can body 10 moves from one of the ink jet heads 240 positioned on the upstream side (the ink jet head 240 on the right side in the figure, which is hereinafter referred to as "upstream-side ink jet head 240A") to the other of the ink jet heads 240 positioned on the downstream side (the ink jet head 240 on the left side in the figure, which is hereinafter referred to as "downstream-side ink jet head 240B") while rotating.

Then, in the exemplary embodiment, the number of rotations of the can body 10 during the period from starting to move the can body 10 from the upstream-side ink jet head 240A to reaching the downstream-side ink jet head 240B is an integer.

Consequently, in the exemplary embodiment, when the can body 10 reaches the downstream-side ink jet head 240B, an adhesion starting position P1 of the can body 10, where the ink ejected from the upstream-side ink jet head 240A is adhered first, is positioned at a position facing the downstream-side ink jet head 240B.

Accordingly, in the exemplary embodiment, a sensor or controlling for alignment becomes unnecessary.

Here, in the upstream-side ink jet head 240A, a strip-shaped image extending from the adhesion starting position P1 (the position indicated by the reference sign 3A) where the ink is first adhered to an adhesion finishing position P2 (the position similarly indicated by the reference sign 3A) where the ink is finally adhered is formed on the outer circumferential surface of the can body 10.

Then, in the exemplary embodiment, the can body 10 moves while rotating, and when the can body 10 reaches below the downstream-side ink jet head 240B, the adhesion starting position P1 is located at the position facing the lower surface 241 of the downstream-side ink jet head 240B.

Then, in the exemplary embodiment, ink is ejected at the same time when the can body 10 reaches below the downstream-side ink jet head 240B, to thereby perform image formation.

More specifically, in the exemplary embodiment, movement of the can body 10 is started at the same time when image formation is finished at the upstream-side ink jet head 240A (at the same time when the adhesion starting position P1 faces the upstream-side ink jet head 240A again after the single rotation of the can body 10).

Then, at the same time when the can body 10 reaches below the downstream-side ink jet head 240B (at the same time when the adhesion starting position P1 faces the downstream-side ink jet head 240B), ejection of ink from the downstream-side ink jet head 240B is started, to thereby start image formation.

Here, in the exemplary embodiment, when image formation at the downstream-side ink jet head 240B is started, the adhesion starting position P1 is positioned directly below the downstream-side ink jet head 240B.

Consequently, in the exemplary embodiment, an image formation starting position when image formation at the upstream-side ink jet head 240A is started and an image formation starting position when image formation at the downstream-side ink jet head 240B is started coincide with each other.

Then, in this case, control for aligning the image formation starting positions becomes unnecessary.

Here, if the adhesion starting position P1 does not face the downstream-side ink jet head 240B when the can body 10 reaches the downstream-side ink jet head 240B, control for causing the adhesion starting position P1 to face the downstream-side ink jet head 240B is required.

Specifically, it becomes necessary to, for example, detect the state of the can body 10 by a rotary encoder or the like, and rotate the can body 10 based on the detection result. In contrast to this, in the exemplary embodiment, such control is unnecessary and the image formation starting positions can be aligned easier.

Here, if the image formation starting positions are aligned, deterioration of image quality due to misalignment of the image formation starting positions can be suppressed.

At the location of the image formation starting positions, a starting point and an end of the image formed in the strip shape overlap or a gap is formed between the starting point and the end, and accordingly, the image quality is likely to be deteriorated.

As in the exemplary embodiment, if the image formation starting positions are aligned, the portions where the image quality is likely to be deteriorated can be concentrated to one location. In contrast to this, if the image formation starting positions are not aligned, the portions where the image quality is deteriorated are apt to be scattered all over the can body 10.

Note that the number of rotations of the can body 10 during the period from starting to move the can body 10 from the upstream-side ink jet head 240A to reaching the downstream-side ink jet head 240B may be any value as long as being an integer, which may be 1 or 2 or more.

Note that, depending on the type of the image to be formed onto the can body 10, the image formation starting positions for forming images at the respective ink jet heads 240 may be shifted. For example, when images consecutive in the circumferential direction are to be formed onto the outer circumferential surface of the can body 10, it is preferable to shift the image formation starting positions in the respective ink jet heads 240.

As described above, when the image formation starting positions are aligned, the portions where the image quality is likely to be deteriorated are concentrated to one location. For this reason, in the case of images consecutive in the circumferential direction of the can body 10, if the image formation starting positions are aligned, there is a possibility that the deterioration of image quality is easily noticeable. In contrast to this, by shifting the image formation starting positions, concentration of low image quality portions on consecutive images can be suppressed.

As a method of shifting the image formation starting positions by the respective ink jet heads 240, though not particularly limited, for example, shifting the ink ejection timing by the respective ink jet heads 240 or differentiating the number of rotations of the can body 10 by the transmission gear 50 can be provided.

Moreover, in the exemplary embodiment, after the can body 10 has reached below each ink jet head 240, the can body 10 may be rotated before starting image formation at each ink jet head 240. To put it another way, after the can body 10 has moved between the ink jet heads 240 by rotation of the rotation member 210 and has reached below the ink jet head 240, the transmission gear 50 is moved in the state where the rotation of the rotation member 210 (movement of the can body 10) is stopped. Consequently, it may be possible that, after rotating the can body 10 (the mandrel 230M) the predetermined number of times, image formation by the ink jet head 240 is started.

When rotation of the rotation member 210 is stopped after the can body 10 is moved to the location below each ink jet head 240 by the rotation of the rotation member 210, the mandrel 230M does not absolutely stop and vibrates in some cases. Particularly, in a case where the shaft 230S extending from the rotation member 210 is long or the rotation speed of the rotation member 210 is high, vibration of the mandrel 230M attached to a circumferential end of the shaft 230S is apt to be increased.

Then, when the mandrel 230M vibrates, the can body 10 supported by the mandrel 230M also vibrates, and thereby, deterioration of image quality occurs in the image formed onto the surface of the can body 10 by the ink jet heads 240 in some cases.

In contrast to this, after the can body 10 has reached below the ink jet head 240, the can body 10 is rotated and image formation by the ink jet head 240 is started. More specifically, after the can body 10 reached below the ink jet head 240 and a certain period of time has passed since rotation of the can body 10, image formation by the ink jet head 240 is started. This suppresses vibration of the can body 10 when image formation is started, to thereby suppress deterioration of image quality in the image formed onto the can body 10.

Other than this, it may be possible to stop the rotation of the can body 10 or reduce the rotation speed of the can body 10 while the can body 10 reaches below the ink jet head 240 and is rotated for a certain period of time. However, in this case, when image formation by the ink jet head 240 is started, it is necessary to accelerate the can body 10, which has been stopped or decelerated, to the rotation speed required to perform image formation, and vibration sometimes occurs in the can body 10 on this occasion. Consequently, it is preferable that the rotation speed of the can body 10 is at the same degree as the rotation speed in image formation.

Moreover, by providing a configuration in which, below each ink jet head 240, the can body 10 is rotated an integer number of times in the state where rotation of the rotation member 210 (movement of the can body 10) is stopped, it becomes easy to align the image formation starting positions with respect to the respective ink jet heads 240. This further suppresses deterioration of image quality due to misalignment of the image formation starting positions.

Still further, in the exemplary embodiment, the moving direction of the can body 10 by the rotation member 210 and the rotation direction of the can body 10 at the position facing the ink jet head 240 coincide with each other. By adopting such a configuration, the moving direction of the surface of the can body 10 as viewed from the ink jet head 240 side is constant (always the same direction). Consequently, as compared to a case in which, for example, the moving direction of the can body 10 by the rotation member 210 and the rotation direction of the can body 10 at the position facing the ink jet head 240 do not coincide with each other, occurrence of air turbulence is suppressed.

As a result, behavior of ink ejected from the ink jet head 240 becomes stable, and it is possible to control the ink ejection position with respect to the can body 10 with more accuracy. As a result, deterioration of image quality formed onto the can body 10 is further suppressed.

With reference to FIG. 1, operations after the can body 10 has passed through the ink jet heads 240 will be described.

The can body 10 passed through the ink jet heads 240 moves to the location below the UVLED lamp 250, and the outer circumferential surface of the can body 10 is irradiated with ultraviolet light. Specifically, the can body 10 is rotated below the UVLED lamp 250, and thereby the outer circumferential surface of the can body 10 is irradiated with the ultraviolet light. Consequently, the ink on the outer circumferential surface of the can body 10 is cured.

Here, as described above, in the case where the can body 10 is rotated before starting image formation at the ink jet head 240, the can body 10 conveyed to the location below the UVLED lamp 250 is rotated similarly.

In this case, at the UVLED lamp 250, different from the ink jet head 240, irradiation of the ultraviolet light may be started in time with starting the rotation of the can body 10. Consequently, as compared to a case in which, for example, irradiation of the ultraviolet light is started after the can body 10 is rotated a predetermined number of times, irradiation time of the ultraviolet light against the can body 10 becomes longer. Therefore, the ink on the outer circumferential surface of the can body 10 is more likely to be cured.

Moreover, the ultraviolet cure ink is cured by a certain amount of light. Therefore, since the irradiation time of the ultraviolet light against the can body 10 can be made longer, it becomes possible to reduce illumination of the UVLED lamp 250, which is the light source. Consequently, it becomes possible to extend the life of the UVLED lamp 250.

Thereafter, in the exemplary embodiment, a paint is applied onto the outer circumferential surface of the can body 10 by the paint application device 94.

Next, at the can body discharge portion 95, the compressed air is supplied to the inside of the mandrel 230M, the compressed air supplied to the inside of the mandrel 230M is then supplied to the outside of the mandrel 230M via the laid ventilation hole (not shown), and the compressed air supplied to the outside of the mandrel 230M presses the inner surface of the can body 10 mounted to the mandrel 230M, to thereby detach the can body 10 from the mandrel 230M. The can body 10 detached from the mandrel 230M is conveyed to a not-shown baking operation and heating processing is performed. Consequently, the paint applied to the can body 10 is cured.

Figure 5:
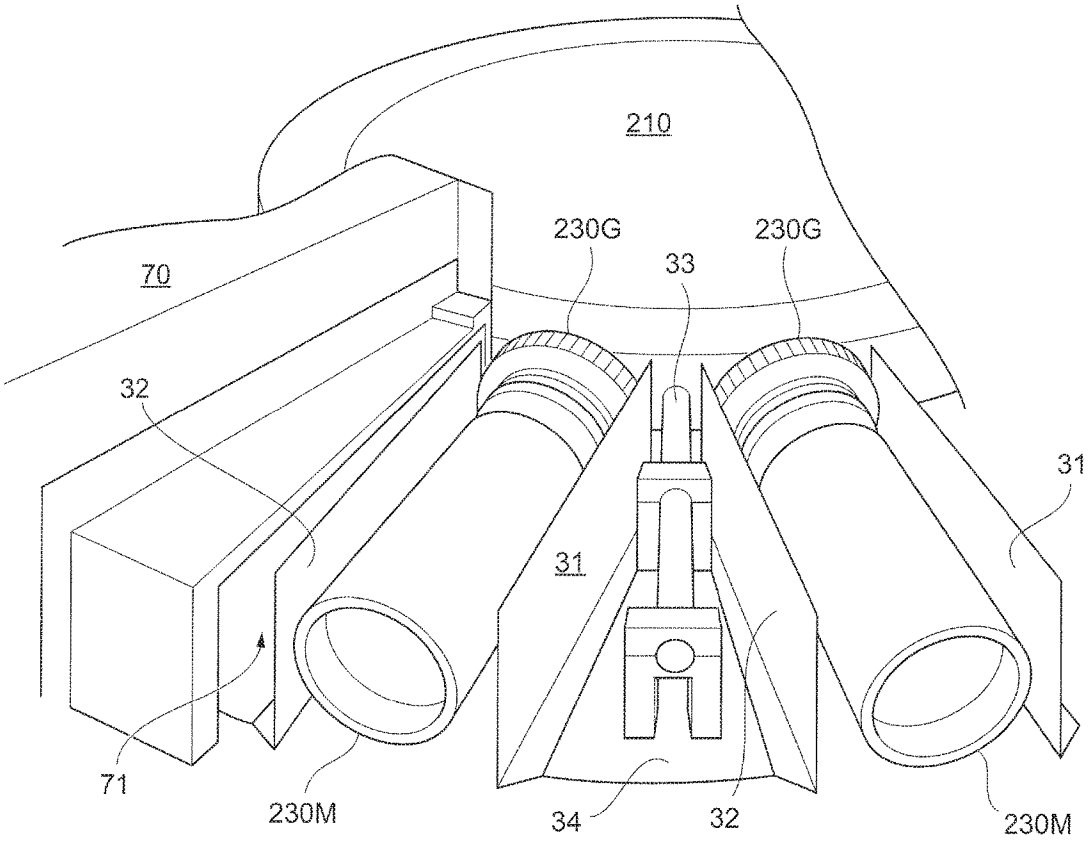
FIG. 5 is a diagram in which a lamp container box and mandrels are viewed from a direction of arrow V in FIG. 1.

FIG. 5 is a diagram in which a lamp container box 70 and the mandrels 230M are viewed from a direction of arrow V in FIG. 1. Note that, in FIG. 5, illustration of the can body 10 is omitted.

Though the description is omitted in the above, in the exemplary embodiment, as shown in FIG. 5, an upstream-side restricting wall 31 and a downstream-side restricting wall 32 are provided beside each mandrel 230M (each can body 10).

The upstream-side restricting wall 31 is positioned on the upstream side of the mandrel 230M in the rotation direction of the rotation member 210, and the downstream-side restricting wall 32 is positioned on the downstream side of the mandrel 230M in the rotation direction of the rotation member 210.

Moreover, the upstream-side restricting wall 31 and the downstream-side restricting wall 32 are provided along the axial direction of the mandrel 230M and also along the vertical direction.

Moreover, the plural (plural sets of) upstream-side restricting wall 31 and downstream-side restricting wall 32 are provided to correspond to the respective plural mandrels 230M (can bodies 10), and move in association with the respective mandrels 230M.

In the exemplary embodiment, a support shaft 33 protruding from the outer circumferential surface of the rotation member 210 is provided, and the upstream-side restricting wall 31 and the downstream-side restricting wall 32 are supported by the support shaft 33.

The support shaft 33 is disposed between two mandrels 230M adjacent to each other in the rotation direction of the rotation member 210, and a plate material 34 extending along the horizontal direction is attached to the support shaft 33. The upstream-side restricting wall 31 and the downstream-side restricting wall 32 are supported by the plate material 34.

As shown in FIG. 1, the upstream-side restricting wall 31 is positioned on the upstream side (the side on which an ink jet head 240 is provided) of the can body 10 when the can body 10 is stopped at a mandrel stop location 811 (light irradiation stop location 811). The upstream-side restricting wall 31 is thereby positioned between the can body 10 and the ink jet head 240, and ultraviolet light is restricted from heading toward the ink jet head 240.

Further, as shown in FIG. 1, when the can body 10 stops at the mandrel stop location 811, the upstream-side restricting wall 31 closes the inlet portion 71 (also refer to FIG. 5) of the lamp container box 70. Consequently, the ultraviolet light is prevented from heading toward the ink jet head 240 through the inlet portion 71.

On the other hand, as shown in FIG. 1, when the can body 10 stops at the mandrel stop location 811, the downstream-side restricting wall 32 is positioned on the downstream side of the can body 10. Consequently, leakage of the ultraviolet light from the outlet portion 72 of the lamp container box 70 can be suppressed.

Here, it is possible to provide shatters that are moved by a driving source, such as a solenoid, to the inlet portion 71 and the outlet portion 72, to thereby close the inlet portion 71 and the outlet portion 72 by the shatters.

However, in this case, when the can body 10 passes through the inlet portion 71 and the outlet portion 72, the shatters are required to be retracted, and thereby the configuration is complicated. In the exemplary embodiment, without causing such complication of the configuration, the inlet portion 71 and the outlet portion 72 can be closed.

Figure 6:
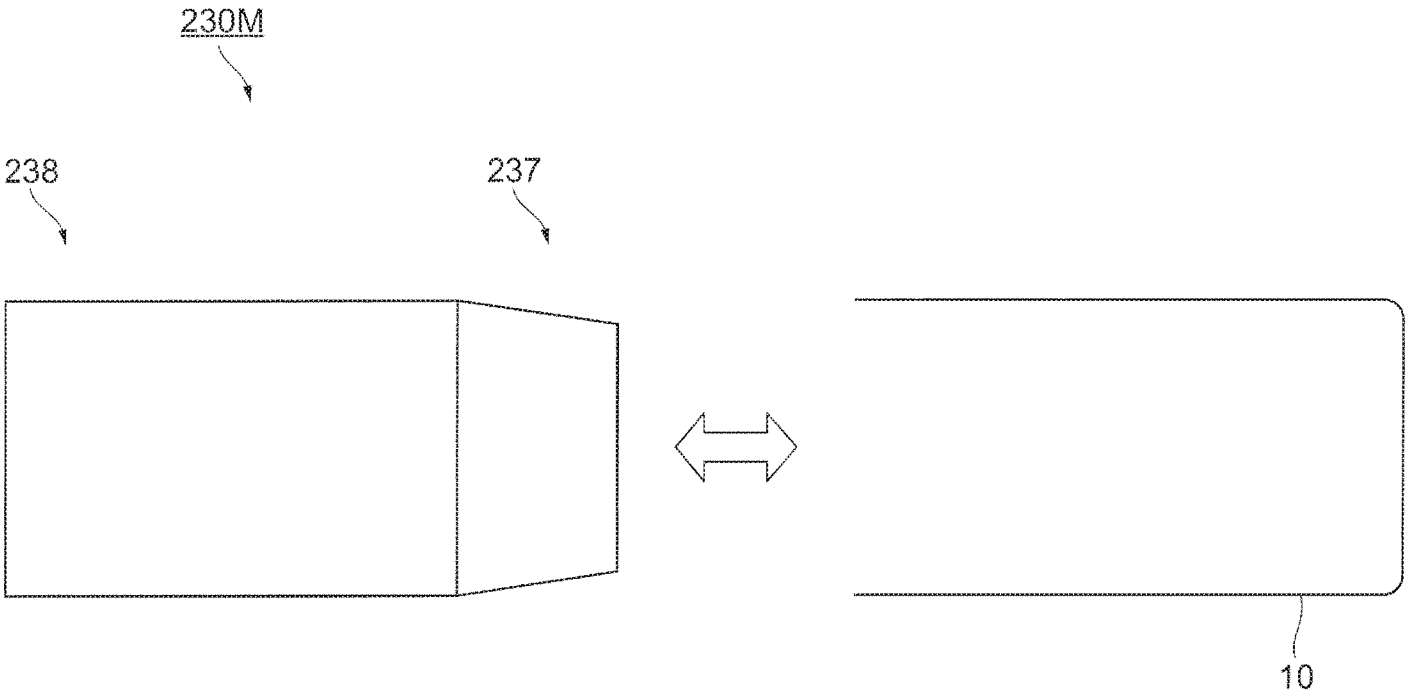
FIG. 6 is a diagram illustrating the mandrel.

FIG. 6 is a diagram illustrating the mandrel 230M.

The mandrel 230M in the exemplary embodiment as an example of a cylindrical member is formed of a member in a cylindrical shape. Further, in the exemplary embodiment, the diameter of one end portion 237 is smaller than the diameter of the other end portion 238.

More specifically, in the exemplary embodiment, when the mandrel 230M is inserted into the can body 10 with the one end portion 237 in the lead, and the diameter of the one end portion 237 side is smaller than the diameter of the other end portion 238 side. To describe further, in the exemplary embodiment, the outer circumferential surface and the one end portion 237 of the mandrel 230M are tapered in such a way that the outer diameter of the mandrel 230M is reduced with a move from the other end portion 238 side toward the one end portion 237 side.

Here, when the diameter of the one end portion 237 side is made smaller than the diameter of the other end portion 238 side as in the exemplary embodiment, wear of the mandrel 230M is suppressed.

More specifically, when the mandrel 230M is inserted into the can body 10, a tip end of the mandrel 230M is less likely to contact the can body 10, and therefore, wear of the mandrel 230M is suppressed.

Particularly, in the exemplary embodiment, since the mandrel 230M is inserted into the can body 10 in the state where the mandrel 230M is rotating (since, in the can body loading portion 91 (refer to FIG. 1), the can body 10 is mounted to the mandrel 230M that is rotating), wear of the mandrel 230M is apt to occur. If the diameter of the one end portion 237 side is made smaller as in the exemplary embodiment, the wear is less likely to occur.

Note that, in the exemplary embodiment, as a result of the diameter of the one end portion 237 side being made smaller, a gap is formed between the outer circumferential surface of the one end portion 237 and the inner circumferential surface of the can body 10. In the exemplary embodiment, even though such a gap exists, since printing is performed by the ink jet method (since printing is performed by adhering ink changed into minute ink droplets, and no external force is generated in the can body 10 during printing), image formation onto the can body 10 can be performed without deforming the can body 10 by printing. Here, in a plate processing method, not in the ink jet method, that transfers an image by pressing a plate against the outer circumferential surface of the can body 10, the can body 10 is dented inward at the portion where the gap is formed, and thereby the can body 10 is deformed.

(Others)

In the exemplary embodiment, as described above, the UVLED lamp 250 is installed on the downstream side of the plural ink jet heads 240, and after the image formation onto the can body 10 by the plural ink jet heads 240 is performed, light irradiation by the UVLED lamp 250 is carried out.

To put it another way, irradiation of ultraviolet light is not performed every time the image formation by a single ink jet head 240 is conducted, but is performed after images are formed by 6 ink jet heads 240.

In this case, the number of UVLED lamps 250 can be reduced as compared to the case in which irradiation of ultraviolet light is performed every time the image formation by a single ink jet head 240 is carried out. Moreover, if the number of UVLED lamps 250 is reduced, the printing apparatus 100 can be downsized.

Note that irradiation of ultraviolet light may be performed every time the image formation by a single ink jet head 240 is carried out; in this case, each new mandrel stop locations is provided between two ink jet heads 240 that are adjacent to each other in the moving direction of the can body 10, and the UVLED lamp 250 is installed to the mandrel stop location.

Note that, in this case also, it is preferable to provide one or more other mandrel stop locations are provided between the new mandrel stop location where the UVLED lamp 250 is installed and the mandrel stop location where the ink jet head 240 is installed.

More specifically, in this case, the ink jet head 240 is provided on each of the upstream side and downstream side of a single UVLED lamp 250, and it is preferable to provide the one or more mandrel stop locations between the single UVLED lamp 250 and the upstream-side ink jet head 240 and between the single UVLED lamp 250 and the downstream-side ink jet head 240.

Moreover, when irradiation of ultraviolet light is performed every time the image formation by the ink jet head 240 is carried out, it may be possible that the ink jet head 240 and the UVLED lamp 250 are provided to a single mandrel stop location and image formation and irradiation of ultraviolet light are performed at each single mandrel stop location.

More specifically, the ink jet head 240 is provided to one of the two locations at positions different from each other in the rotation direction of the can body 10 and the UVLED lamp 250 is provided to the other location (to the location on the downstream side of the ink jet head 240), and the ultraviolet light is irradiated after image formation by the ink jet head 240.

Note that, in this case also, it is preferable to provide the restricting wall that restricts the ultraviolet light from reaching the ink jet head 240 between the UVLED lamp 250 and the ink jet head 240.

REFERENCE SIGNS LIST

10 Can body
31 Upstream-side restricting wall
32 Downstream-side restricting wall
50 Transmission gear
92 Inspection mechanism
93 Discharge mechanism
210 Rotation member
230G Receiving gear
230M Mandrel
237 One end portion
238 The other end portion
240 Ink jet head
250 UVLED lamp
801 to 816 Mandrel stop location (Can body stop location)

The invention claimed is:

1. A printing apparatus comprising:

a can body conveyance unit that sequentially conveys can bodies and, every time each of the can bodies reaches each of a predetermined plurality of can body stop locations, temporarily stops the can body;

an image forming unit that is installed at any of the plurality of can body stop locations and performs image formation onto the can body positioned at the can body stop location; and a light irradiation unit that is installed at another can body stop location positioned on a downstream side of the can body stop location, where the image forming unit is installed, in a conveyance direction of the can bodies, and performs light irradiation to an image formed onto the can body by the image forming unit, wherein one or more other can body stop locations are provided between an image formation stop location, which is the can body stop location where the image forming unit is installed, and a light irradiation stop location, which is the can body stop location where the light irradiation unit is installed.

2. The printing apparatus according to claim 1, further comprising: a restricting wall that restricts light emitted from the light irradiation unit from heading toward the image forming unit.

3. The printing apparatus according to claim 2, wherein a plurality of the restricting walls are provided to correspond to the respective can bodies conveyed by the can body conveyance unit, and move in association with the respective can bodies conveyed by the can body conveyance unit, and the plurality of the restricting walls are provided, when one of the can bodies is stopped at the light irradiation stop location, to cause one of the plurality of the restricting walls corresponding to the can body to be positioned on an upstream side of the can body in the can body conveyance direction.

4. The printing apparatus according to claim 2, wherein two or more of the restricting walls are provided for each of the can bodies, and, when the each can body is stopped at the light irradiation stop location, one of the restricting walls corresponding to the can body is positioned on an upstream side of the can body in the can body conveyance direction, and the other of the restricting walls corresponding to the can body is positioned on a downstream side of the can body in the can body conveyance direction.

5. The printing apparatus according to claim 1, wherein the image forming unit performs image formation on the can body by ejecting ink onto the can body, and an ink ejection direction when the image forming unit ejects the ink and a light emitting direction in light emission by the light irradiation unit are same.

6. The printing apparatus according to claim 1, wherein a plurality of the image forming units are provided, the light irradiation unit is positioned on a downstream side of the plurality of the image forming units in a moving direction of the can body, and light irradiation by the light irradiation unit is performed after image formation onto the can body by the plurality of the image forming units is performed.

7. A printing apparatus comprising:

a plurality of can body support members that are provided rotatably to support can bodies;

an image forming unit that performs image formation onto the can bodies supported by the can body support members; and a transmission member that performs circulating movement through each of the plurality of can body support members to transmit a rotational driving force to each of the plurality of can body support members.

8. The printing apparatus according to claim 7, wherein the plurality of can body support members are radially disposed around a predetermined disposition center, the transmission member is formed into an annular shape to perform circulating movement assuming a center in a radial direction as a movement center, and the plurality of can body support members and the transmission member are provided to cause the disposition center and the movement center to coincide with each other.

9. The printing apparatus according to claim 8, wherein the transmission member is installed closer to the disposition center side than the plurality of can body support members that are radially disposed.

10. The printing apparatus according to claim 8, wherein a receiving member that receives a driving force from the transmission member is provided to each of the can body support members, and the receiving member is formed into a helical shape.

11. The printing apparatus according to claim 7, wherein a receiving member that receives a driving force from the transmission member is provided to each of the plurality of can body support members, and the receiving member is more likely to wear than the transmission member.

12. The printing apparatus according to claim 7, wherein a plurality of the image forming units are provided, and the printing apparatus further comprises a moving unit that moves the can body support members through each of the plurality of the image forming units.

13. A printing apparatus comprising:

a plurality of image forming units, each of which ejects ink onto an outer circumferential surface of a rotating can body to form an image on the outer circumferential surface; and a moving unit that moves a can body through each of the plurality of image forming units while rotating the can body, wherein a number of rotations of the can body during a period from starting to move the can body from one of two of the image forming units adjacent to each other in a moving direction of the can body to reaching the other of the two image forming units becomes an integer.

14. The printing apparatus according to claim 13, wherein, when image formation onto the can body is performed at each of the plurality of image forming units, the can body is rotated for a predetermined number of rotations, and, when the can body is moved from one of the two image forming units to the other thereof, the can body is rotated for a number of rotations larger than the predetermined number of rotations.

15. The printing apparatus according to claim 13, wherein, when image formation onto a can body is performed at each of the plurality of image forming units, the can body is rotated at a predetermined number of rotations, and, when the can body is moved from one of the two image forming units to the other thereof, the can body is rotated for a number of rotations smaller than the predetermined number of rotations.

16. The printing apparatus according to claim 13, further comprising:

an inspection unit that performs inspection of a can body before image formation onto the can body by the plurality of image forming units is performed; and a discharge unit that discharges a can body, which is determined not to satisfy a predetermined condition by the inspection unit, before image formation onto the can body by the plurality of image forming units is performed.

17. The printing apparatus according to claim 13, wherein the can body is supported by a cylindrical member inserted into the can body, and the cylindrical member is formed with a diameter of one end portion side in a lead when being inserted into the can body to be smaller than a diameter of the other end portion side.

18. A printing apparatus comprising:

a plurality of image forming units, each of which ejects ink onto an outer circumferential surface of a rotating can body to form an image on the outer circumferential surface;

a moving unit that moves and stops a can body to and at each of the plurality of image forming units to cause the can body to pass through each of the plurality of image forming units; and a rotating unit that rotates a can body after the can body is stopped at each of the plurality of image forming units by the moving unit, wherein each of the plurality of image forming units starts image formation onto the can body after the can body is rotated a predetermined number of times by the rotating unit.

19. The printing apparatus according to claim 18, wherein each of the image forming units starts image formation onto the can body after the can body is rotated an integer number of times by the rotating unit.

20. The printing apparatus according to claim 18, wherein the rotating unit rotates the can body to cause image formation starting positions by the respective image forming units to coincide with one another.

21. The printing apparatus according to claim 18, wherein the rotating unit rotates the can body to cause image formation starting positions by the respective image forming units to be shifted in a circumferential direction of the can body.

22. The printing apparatus according to claim 18, wherein the rotating unit rotates the can body to cause a moving direction of the can body by the moving unit and a rotation direction of the can body at a portion facing each of the image forming units to coincide with each other.

23. The printing apparatus according to claim 18, further comprising:

a light irradiation unit that is provided on a downstream side of the plurality of image forming units in a moving direction of the can body and performs light irradiation onto the image formed on the can body by the plurality of image forming units, wherein the rotating unit rotates a can body after the can body is stopped at the light irradiation unit by the moving unit, and the light irradiation unit starts light irradiation onto the can body when the can body is rotated by the rotating unit.

* * * * *